US008276716B2

(12) United States Patent
Meri et al.

(10) Patent No.: US 8,276,716 B2
(45) Date of Patent: Oct. 2, 2012

(54) ARRANGEMENT AND METHOD FOR DETERMINING THE POSITION OF AN ELEVATOR CAR BY INDUCTIVELY CONNECTING POSITION IDENTIFIER TO ELECTROMAGNETIC RADIO-FREQUENCY MEASURING SIGNAL FROM MEASURING APPARATUS

(75) Inventors: Timo Meri, Riihimäki (FI); Tommi Loukas, Riihimäki (FI); Petteri Kangas, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/274,028

(22) Filed: Oct. 14, 2011

(65) Prior Publication Data

US 2012/0031710 A1 Feb. 9, 2012

Related U.S. Application Data

(63) Continuation of application No. 12/984,815, filed on Jan. 5, 2011, now Pat. No. 8,123,003.

(51) Int. Cl.
*B66B 1/34* (2006.01)
*B66B 3/02* (2006.01)

(52) U.S. Cl. ..... 187/394; 187/247

(58) Field of Classification Search ..... 187/247, 187/391–394

See application file for complete search history.

(56) References Cited

U.S. PATENT DOCUMENTS

| | | | | |
|---|---|---|---|---|
| 4,134,476 | A | 1/1979 | Zolnerovich et al. | |
| 5,085,294 | A | 2/1992 | Iwata | |
| 5,509,505 | A | 4/1996 | Steger et al. | |
| 5,682,024 | A | 10/1997 | Koopman, Jr. et al. | |
| 5,821,477 | A | 10/1998 | Gerstenkorn | |
| 5,889,239 | A | 3/1999 | Blackaby et al. | |
| 6,435,315 | B1 | 8/2002 | Zaharia | |
| 6,874,244 | B2 | 4/2005 | Birrer et al. | |
| 7,441,631 | B2 | 10/2008 | Oh et al. | |
| 7,493,991 | B2 | 2/2009 | Oh et al. | |
| 7,597,176 | B2 | 10/2009 | Zaharia | |
| 7,600,613 | B2 | 10/2009 | Kang et al. | |
| 7,699,143 | B2 | 4/2010 | Tschuemperlin et al. | |
| 8,123,003 | B2 * | 2/2012 | Meri et al. | 187/394 |
| 2005/0039987 | A1 | 2/2005 | Redden | |
| 2006/0283670 | A1 | 12/2006 | Oh et al. | |
| 2007/0084675 | A1 | 4/2007 | Kang et al. | |
| 2008/0135346 | A1 | 6/2008 | Kattainen et al. | |
| 2011/0147135 | A1 * | 6/2011 | Birrer et al. | 187/393 |
| 2011/0303492 | A1 * | 12/2011 | Sonnenmoser et al. | 187/247 |

FOREIGN PATENT DOCUMENTS

| | | | |
|---|---|---|---|
| EP | 0 757 011 | A2 | 2/1997 |
| EP | 0 847 953 | A1 | 6/1998 |
| WO | WO 01/37202 | A1 | 5/2001 |
| WO | WO 2004/028946 | A1 | 4/2004 |

* cited by examiner

*Primary Examiner* — Anthony Salata

(74) *Attorney, Agent, or Firm* — Birch, Stewart, Kolasch & Birch, LLP

(57) ABSTRACT

An arrangement and a method are provided for determining the position of an elevator car in the elevator hoistway. The arrangement includes a measuring apparatus fitted in connection with the elevator car. The measuring apparatus is arranged to form an electromagnetic radio-frequency measuring signal, for determining the position of the elevator car. The arrangement also includes a position identifier fitted in a selected location in relation to the elevator hoistway. The position identifier is arranged to connect inductively to the electromagnetic radio-frequency measuring signal, and also after it has connected to send a determined pulse pattern using the electromagnetic radio-frequency measuring signal.

12 Claims, 4 Drawing Sheets

Figure 1:
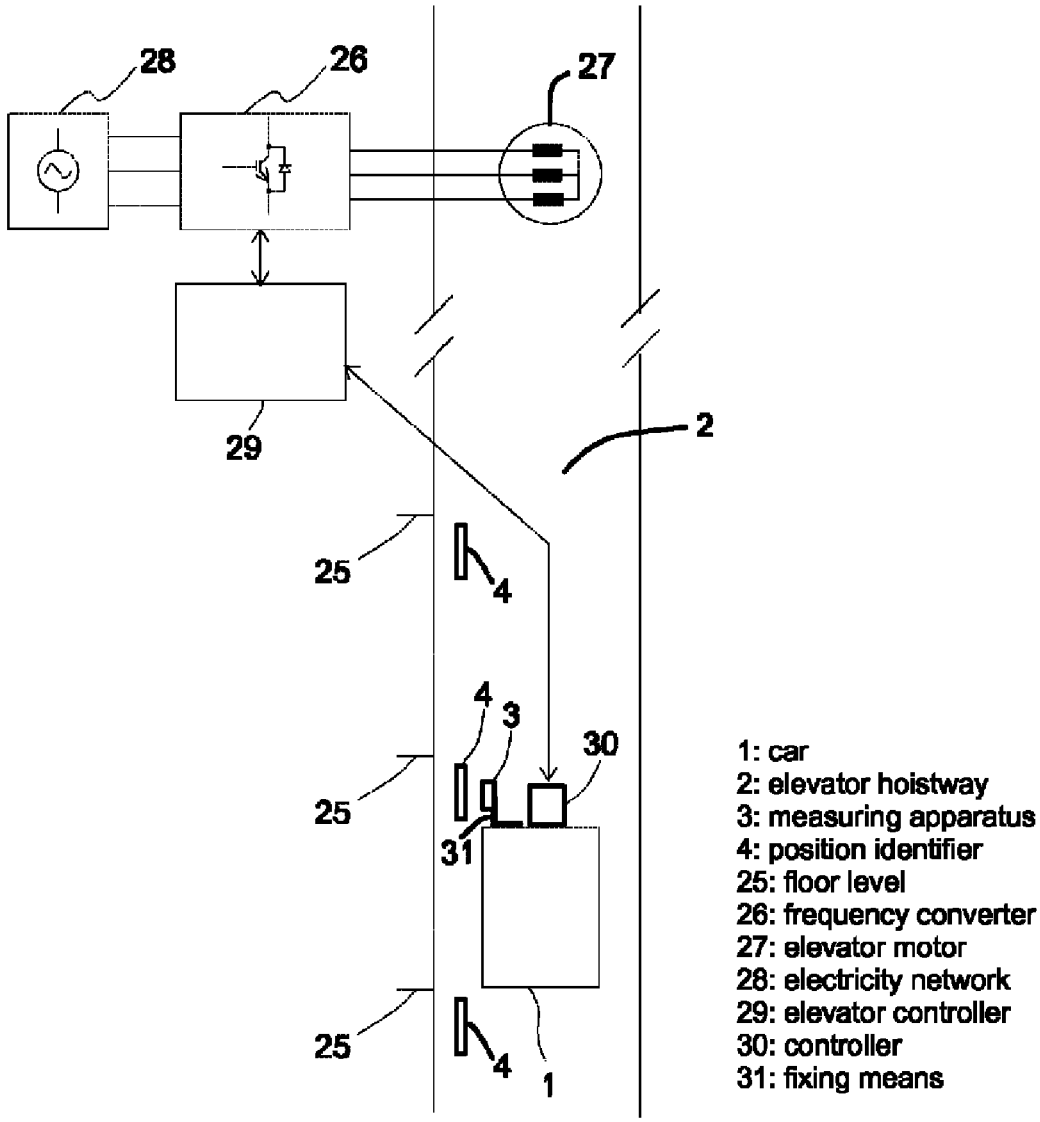

3: measuring apparatus
4: position identifier
5:electromagnetic measuring signal
9, 9': RFID units
19: loop antenna
20: transmitter
21: microcontroller
32: microcircuit
33: transistor
34: high-frequency excitation signal
35: floor zone
36: floor zone

ARRANGEMENT AND METHOD FOR DETERMINING THE POSITION OF AN ELEVATOR CAR BY INDUCTIVELY CONNECTING POSITION IDENTIFIER TO ELECTROMAGNETIC RADIO-FREQUENCY MEASURING SIGNAL FROM MEASURING APPARATUS

This application is a Continuation of application Ser. No. 12/984,815 filed on Jan. 5, 2011 now U.S. Pat. No. 8,123,003, which claims priority to Application No. F120080460 filed in Finland, on Aug. 12, 2008. The entire contents of all of the above applications are hereby incorporated by reference.

The invention relates to an arrangement and a method for determining the position of an elevator car.

The position of the elevator car in the elevator hoistway is conventionally determined with a magnetic switch fixed to the elevator car. In this case permanent magnets are disposed in the elevator system on the floor levels as well as at the end zone of the elevator hoistway, among other places. According to the basic principle of position determination, the mechanical contact of the magnetic switch fixed to the elevator car changes its state when the magnetic switch is taken into the proximity of a permanent magnet fitted in the elevator hoistway.

The mechanical contact of the magnetic switch does not express the explicit position of the elevator car. For this reason the elevator car must drive to a known reference point in the elevator hoistway after losing the position information. This type of searching for the position of the elevator car must be performed e.g. after an electricity outage.

The mechanical contacts of magnetic switches are unreliable; vibration or an impact may cause failure of the contact, and mechanical contacts also oxidize easily.

The purpose of the invention is to solve the aforementioned problems as well as the problems disclosed in the description of the invention below. Therefore the invention presents a determination of the position of the elevator car that is more reliable and simpler than prior art.

The arrangement according to the invention for determining the position of an elevator car in the elevator hoistway is characterized by what is disclosed in the characterization part of claim 1. The method according to the invention for determining the position of an elevator car in the elevator hoistway is characterized by what is disclosed in the characterization part of claim 6. The measuring apparatus according to the invention for determining the position of a moving object is characterized by what is disclosed in the characterization part of claim 10. The position identifier according to the invention for determining the position of a moving object is characterized by what is disclosed in the characterization part of claim 11. Other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

The arrangement according to the invention for determining the position of an elevator car in the elevator hoistway comprises: a measuring apparatus fitted in connection with the elevator car, which measuring apparatus is arranged to form an electromagnetic radio-frequency measuring signal, for determining the position of the elevator car; and also a position identifier fitted in a selected location in relation to the elevator hoistway, which position identifier is arranged to connect inductively to the aforementioned electromagnetic measuring signal, and also after connecting to send a determined pulse pattern to the measuring apparatus via the aforementioned measuring signal.

In the method according to the invention for determining the position of an elevator car in the elevator hoistway: a measuring apparatus that moves along with the elevator car is fitted in connection with the elevator car; the measuring apparatus is arranged to form an electromagnetic radio-frequency measuring signal, for determining the position of the elevator car; a position identifier is fitted in a selected location in relation to the elevator hoistway; the position identifier is arranged to connect inductively to the aforementioned electromagnetic measuring signal; and also after connecting to send a determined pulse pattern to the measuring apparatus via the aforementioned measuring signal.

The measuring apparatus for determining the position of a moving object according to the invention comprises: an apparatus frame, comprising a mechanical fixing interface to the moving object; an output for the position information of the moving object; a circuit board fixed to the apparatus frame, as well as fitted to the circuit board: a loop antenna formed on the circuit board; a transmitter connected to the antenna; and also a controller connected to the transmitter. The circuit board is fitted to be connected to the moving object via the apparatus frame such that the surface of the circuit board is essentially in the direction of movement, and the loop antenna of the circuit board is arranged to form an electromagnetic radio-frequency measuring signal in essentially the perpendicular direction to the movement of the object, for determining the position of the moving object.

The position identifier according to the invention for determining the position of a moving object comprises an RFID unit and also a fixing interface for fixing the position identifier in relation to the path of movement of the object. The position identifier is fitted to be fixed for aligning the antenna of the RFID unit such that the antenna connects inductively to the radio-frequency measuring signal formed in an essentially perpendicular direction to the movement of the object.

With the invention at least one of the following advantages, among others, is achieved:

Since the position identifier is passive, no separate electricity supply for the position identifier is needed. In this case the position identifier is easy to fit into the arrangement according to the invention.

The position identifier is fitted to determine the explicit position of the elevator car. In this case, e.g. after an electricity outage the position information of the elevator car can be returned by driving the elevator car into connection with the nearest position identifier, in which case searching for the position of the elevator car according to prior art does not need to be performed.

By means of the checksum of the position identifier, the reliability of the determination of the identification of the position identifier can be improved.

When the position identifier comprises at least two RFID units, the identifications of these can be compared to each other, in which case the condition of the position identifier can be monitored.

The position information of the elevator car can be determined linearly by measuring the magnetic field produced by a permanently-magnetized marking piece. The position information can in this case also be determined with two channels, from the RFID unit and from the permanently-magnetized marking piece, by means of the measuring apparatus according to the invention.

PRESENTATION OF DRAWINGS

Figure 2:
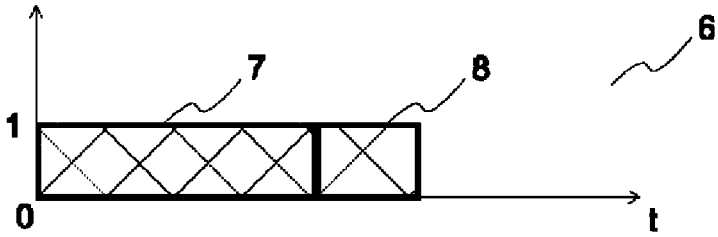
Figure 3:
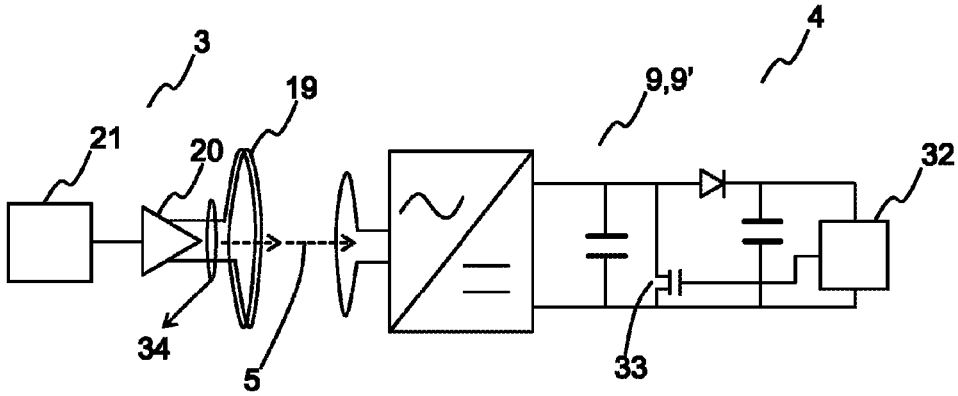
Figure 4:
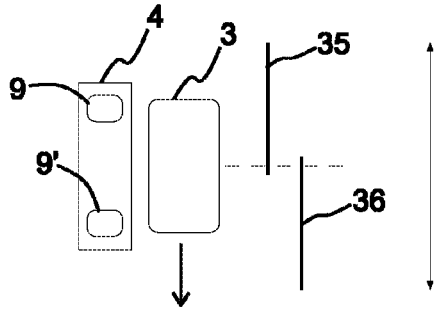
Figure 5:
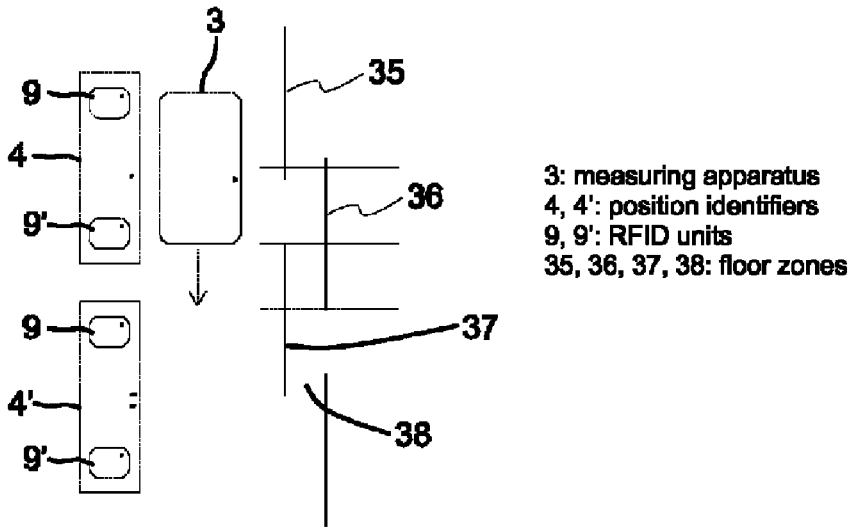
Figure 6:
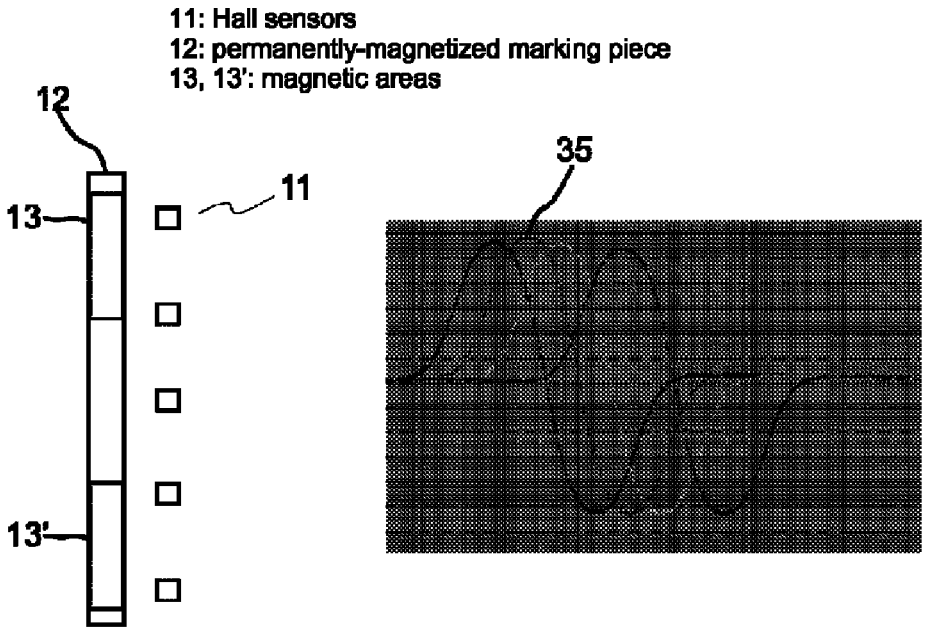
Figure 7:
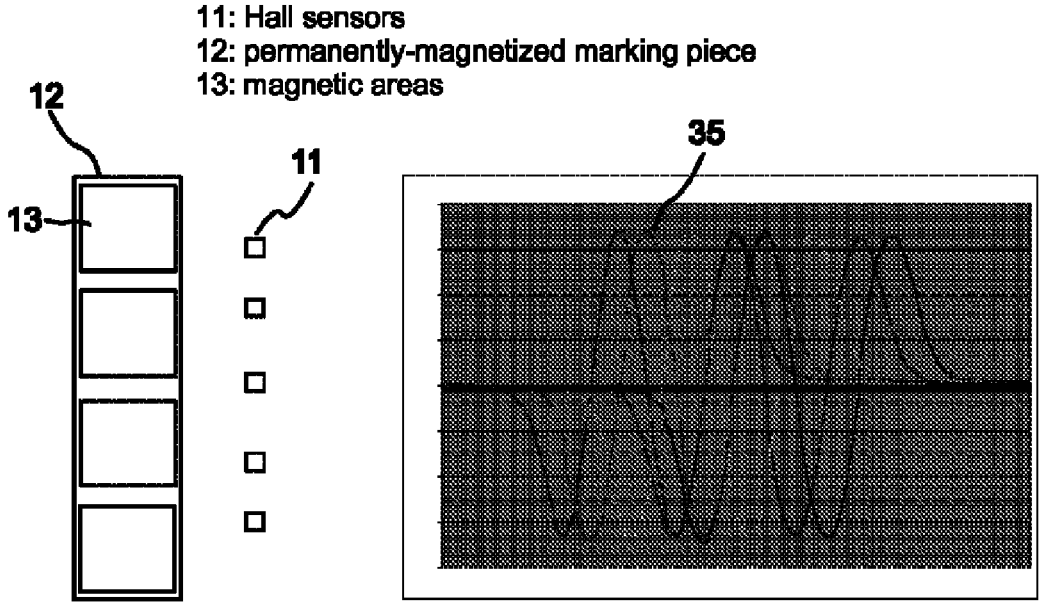
Figure 8:
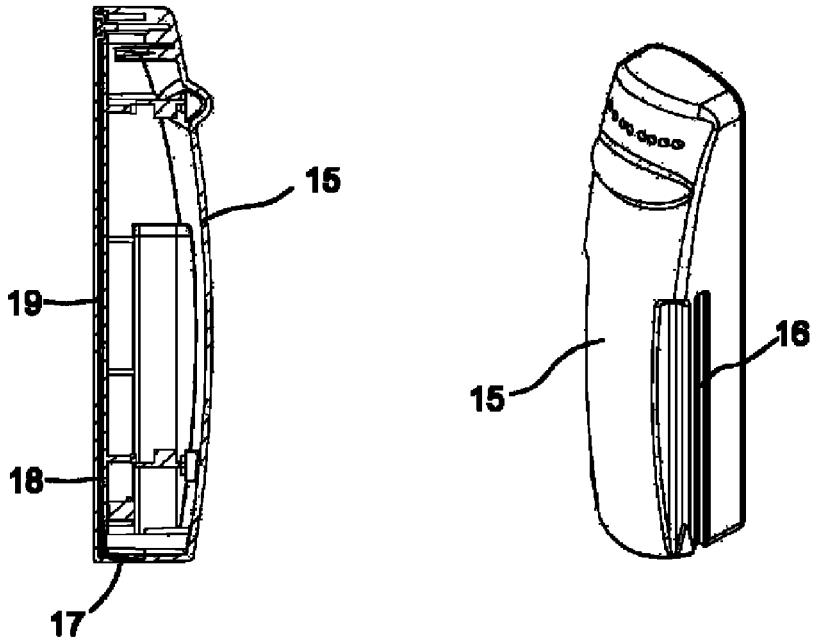

In the following, the invention will be described in more detail by the aid of a few examples of its embodiments with reference to the attached drawings, wherein FIG. 1 presents an elevator system into which an arrangement according to the invention is fitted FIG. 2 presents the structure of a pulse pattern according to the invention FIG. 3 presents an inductive connection of a measuring apparatus and a position identifier FIG. 4 presents an arrangement according to the invention for determining the position of the floor level of the elevator FIG. 5 presents an arrangement according to the invention for determining the terminal floor and also the end limits of the elevator hoistway FIG. 6 presents one arrangement according to the invention for determining the linear position of the elevator car FIG. 7 presents a second arrangement according to the invention for determining the linear position of the elevator car FIG. 8 presents a structure of the measuring apparatus according to the invention

EMBODIMENTS

FIG. 1 presents an elevator system, in which the elevator car 1 is moved in the elevator hoistway 2 in a manner that is, in itself, prior art. The elevator motor 27 moves the elevator car 1 in the elevator hoistway 2 essentially in the vertical direction between floor levels 25 via the elevator ropes (not shown in the figure). A frequency converter 26 regulates the movement of the elevator motor 27 by adjusting the power supply between the electricity network 28 and the elevator motor. Adjustment of the movement of the elevator car and also regulation of the elevator traffic occurs with the elevator controller 29, as a response to calls sent from the floor levels 25 as well as to car calls sent from the elevator car and transmitted by the controller 30 of the elevator car.

One arrangement according to the invention for determining the position of the elevator car 1 in the elevator hoistway 2 is fitted to the elevator system according to FIG. 1. A measuring apparatus 3 is fixed in connection with the roof of the elevator car 1 with fixing means 31. The measuring apparatus 3 comprises a loop antenna, which is aligned such that the direction of the electromagnetic radio-frequency measuring signal 5 of the antenna is essentially at right angles with respect to the direction of movement of the elevator car. Position identifiers 4 are fitted in selected locations in relation to the elevator hoistway 2. The position identifiers 4 are e.g. fixed to the guide rail (not in figure) of the elevator car in connection with the floor levels 25 with a magnetic fixing. In the situation of FIG. 1, the floor of the elevator car 1 is situated at the floor level 25, in which case the measuring apparatus 3 and the position identifier 4 corresponding to the floor level are situated opposite each other as shown in the figure. In this case, when the position identifier 4 of the floor level is situated in the immediate proximity of the electromagnetic measuring signal 5 formed by the measuring apparatus 3, the position identifier 4 connects inductively to the aforementioned electromagnetic measuring signal 5. After connecting, the position identifier sends a determined pulse pattern 6 to the measuring apparatus 3 via the aforementioned measuring signal 5. The measuring apparatus 3 individualizes the position identifier 4 in question on the basis of the pulse pattern 6. The position thus determined is conveyed from the measuring apparatus 3 first to the controller 30 of the elevator car, and onwards from the controller of the elevator car to the elevator controller 29, along the traveling cable or e.g. a wireless data transfer channel. FIG. 3 presents the connecting mechanism between the measuring apparatus 3 and the position identifier 4. FIG. 2 presents the pulse pattern 6 formed by the position identifier.

In FIG. 3 the measuring apparatus 3 is disposed in the immediate proximity of the position identifier 4. A high-frequency excitation signal 34 is supplied with the transmitter 20 to the loop antenna 19 of the measuring apparatus 3. The loop antenna forms an electromagnetic radio-frequency measuring signal 5 in response to the excitation signal. When the antenna of the position identifier 4 is situated at an essentially shorter distance from the loop antenna of the measuring apparatus 3 than the wavelength of the measuring signal 5, the antenna of the position identifier 4 inductively connects to the aforementioned measuring signal 5. In one embodiment of the invention the frequency of the electromagnetic measuring signal 5 is 13.56 MHz. The distance between the loop antenna 19 of the measuring apparatus and the antenna of the position identifier 4 is in this case at most approx. 30 mm.

The position identifier 4 comprises a microcircuit 32, which receives its operating electricity from the measuring signal 5 during the inductive connection. In this case the measuring signal 5 produces a response signal in the antenna of the position identifier, which response signal is rectified into the operating electricity of the microcircuit 32 with a rectifying bridge. The microcircuit changes the loading of the excitation signal 34 via the inductively connected measuring signal 5. The change in the loading occurs by controlling the transistor 33. The microcontroller 21 of the measuring apparatus detects the change in loading as a change in the excitation signal 34. The microcircuit 32 changes the loading of the excitation signal 34 in a controlled manner forming the pulse pattern 6 read from the excitation signal 34 of the measuring apparatus 3.

FIG. 2 presents the structure of one pulse pattern 6 according to the invention. The pulse pattern 6 is in series mode and comprises an individualized identification 7 for the position identifier, for determining the position identifier, and also immediately following this a checksum 8 of the identification. When a position identifier 4 that is individualized by means of identification is fitted in a selected location in relation to the elevator hoistway 1, an explicit location in the elevator hoistway corresponding to the identifier can also be determined.

FIG. 4 presents an arrangement according to the invention for determining the position of a floor level in an elevator system. In the situation according to the figure the measuring apparatus 3 fitted in connection with the elevator car moves in the direction of the arrow past the position identifier 4 fitted into the elevator hoistway. When the loop antenna 19 of the measuring apparatus 3 arrives from above into the immediate proximity of the position identifier 4, the upper 9 of the two RFID units of the position identifier connects inductively to the electromagnetic measuring signal 5 formed by the loop antenna 19 of the measuring apparatus. The measuring apparatus 3 identifies the position identifier by means of the identification of the RFID unit. In this case the measuring apparatus 3 registers that the elevator car has arrived at the known floor zone 35. When the measuring apparatus 3 moves farther downwards in the direction of the arrow, the measuring apparatus arrives in the floor zone 36 according to the identification of the lower RFID unit 9'. The distance in the direction of the movement of the elevator car between the RFID units 9, 9' is set such that the floor zones 35, 36 determined by the RFID units 9, 9' partly overlap each other. The floor level of the elevator is fitted in a place in which the measuring apparatus 3 simultaneously registers the identification of both the upper 9 and the lower 9' RFID unit.

FIG. 5 presents a corresponding arrangement for determining the lowermost floor as well as the final limits of the elevator hoistway. When the measuring apparatus 3 arrives in the direction of the arrow at the position identifier 4 corresponding to the lowermost floor, the position of the floor is registered according to the embodiment of FIG. 4. A second position identifier 4' of the same type is fitted below the position identifier 4. The distance in the direction of the movement of the elevator car between the position identifiers 4, 4' is set such that the zones 36,37 determined by the lower RFID unit 9' of the upper position identifier 4 and the upper RFID unit 9 of the lower position identifier 4' partly overlap each other. The overlap between these zones 36, 37 forms a direction-dependent end limit. When it arrives at the direction-dependent end limit the elevator car must change its direction upwards to leave the end zone. If the elevator car however continues its travel farther downwards, the final limit is reached. The final limit is determined in the zone 38 in which the measuring apparatus 3 simultaneously registers the identifications of both the RFID units 9, 9' of the lower position identifier 4'. In this case the elevator control 29 prevents movement of the elevator car by controlling a mechanical stopping apparatus. The elevator control also prevents restarting of the run.

When determining the topmost floor of the elevator hoistway and also the upper end limits of the floor, the position identifiers can be disposed in a corresponding manner in the top part of the hoistway.

FIG. 6 presents an arrangement according to the invention for determining the linear position of the elevator car. Hall sensors 11 are fitted to the measuring apparatus 3 for measuring the external magnetic field. A permanently-magnetized marking piece 12 (as viewed from the side) is fitted to the position identifier 4. The marking piece 12 is of magnetic material in which two consecutive magnetic areas 13, 13' have been made by drawing the marking piece into a powerful external magnetic field. The magnetic poles of the consecutive magnetic areas 13, 13' are made to be of opposite directions to each other. The magnetic areas 13, 13' are arranged at a determined distance from each other in the direction of movement of the elevator car. Five Hall sensors 11 are fitted to the measuring apparatus 3 consecutively in the direction of movement of the elevator car. When the measuring apparatus 3 arrives in the proximity of the marking piece 12, the Hall sensors 11 of the measuring apparatus register a change in the magnetic field. When the measuring apparatus moves past the marking piece, each Hall sensor 11 forms a proportional signal 35 to the magnetic field of the marking piece in relation to the position according to FIG. 6. The perpendicular distance between the marking piece 12 and the Hall sensors is in this case at most approx. 30 mm, and most preferably between approx. 10 mm-15 mm. The phase difference between the signals 35 in FIG. 6 is caused by the interplacement of the Hall sensors. Since the aforementioned signals 35 are essentially sinusoidal in relation to the position, the instantaneous linear position of the elevator car can be determined on the basis of the instantaneous values of the signals 35, e.g. with trigonometric calculations.

FIG. 7 presents an improvement to the arrangement according to FIG. 6. Four separate magnetic areas are made in the marking piece 12 (as seen from the front). The size of each magnetic area is 40 mm×30 mm. The areas are situated consecutively in the direction of movement of the elevator car such that the distance between the center points of consecutive areas is 48 mm. The thickness of the marking piece is 8 mm. Five Hall sensors 11 are fitted to the measuring apparatus 3 consecutively in the direction of movement of the elevator car such that the distances between two consecutive sensors are 24 mm, 36 mm, 36 mm, 24 mm, respectively, starting from the edgemost. In FIG. 7 the Hall sensors 11 are disposed next to the marking piece 12 for the sake of clarity. FIG. 7 also presents the signals 35 of the aforementioned Hall sensors when the measuring apparatus 3 moves past the marking piece 12. The instantaneous linear position of the elevator car is determined on the basis of the instantaneous values of the signals 35. In this case the accuracy of the linear position improves particularly at the point of the edgemost magnetic areas of the marking piece 12.

FIG. 8 presents a construction of a measuring apparatus 3 according to the invention. The measuring apparatus comprises an apparatus frame 15, which comprises a mechanical fixing groove 16 for fixing the measuring apparatus.

The measuring apparatus comprises an output 17 for the measuring data. A circuit board 18 is fixed to the apparatus frame 15. A circulating conductor is fitted into the intermediate layer of the circuit board in the proximity of the edges of the circuit board, which circulating conductor forms a loop antenna 19. A transmitter 20 connected to an antenna is also fixed to the circuit board, as well as a controller 21, which is connected to the transmitter 20. The transmitter 20 is controlled and also the excitation signal 34 supplied by the transmitter is read, both with the controller 21, for determining the position identifier 4. In one embodiment of the invention Hall sensors 11 are additionally fitted to the circuit board 18 for measuring the external magnetic field.

In one embodiment of the invention the means 11 for measuring the external magnetic field comprise a magnetoresistive sensor.

The invention is described above by the aid of a few examples of its embodiment. It is obvious to the person skilled in the art that the invention is not limited to the embodiments described above, but that many other applications are possible within the scope of the inventive concept defined by the claims presented below.

It is obvious to the person skilled in the art that the elevator system according to the invention can comprise a counterweight, or the elevator system can also be without a counterweight.

It is also obvious to the person skilled in the art that the measuring apparatus according to the invention can be fitted in a selected location with relation to the elevator hoistway, in which case the position identifier according to the invention can be fitted in connection with the elevator car. In this case the interpositioning of the position identifier and the measuring apparatus is fitted in the manner presented in the invention.

It is further obvious to the person skilled in the art that the elevator system according to the invention can comprise more than one elevator car fitted into the same elevator hoistway. In this case the measuring apparatus according to the invention can be fitted in connection with more than one elevator car fitted into the same elevator hoistway.

It is additionally obvious to the person skilled in the art that the measuring apparatus according to the invention can be fixed in connection with the mechanics that moves along with the elevator car, such as in connection with the sling of the elevator car or e.g. the counterweight.

It is also obvious to the skilled person that more position identifiers can be fitted to the end zone of the elevator hoistway in a corresponding manner, for determining possible additional end limits. In this case the safety of the elevator system can be further improved e.g. when the speed of the elevator car and/or the movement area of the mechanical end buffer increases.

The invention claimed is:

1. An arrangement for determining a position of an elevator car in an elevator hoistway, wherein the arrangement comprises:

a measuring apparatus fixed to the elevator car and forming an electromagnetic radio-frequency measuring signal, for determining the position of the elevator car; and a position identifier fitted in a selected location in relation to the elevator hoistway, wherein the position identifier is arranged to connect inductively to the electromagnetic radio-frequency measuring signal, and also after connecting, to send a determined pulse pattern to the measuring apparatus via the electromagnetic radio-frequency measuring signal;

wherein the measuring apparatus individualizes the position identifier in question based on the determined pulse pattern, and wherein the position identifier comprises at least two RFID units spaced apart from each other with a predetermined distance in the direction of movement of the elevator car.

2. The arrangement according to claim 1, wherein the pulse pattern formed by the position identifier comprises an identification of the position identifier as well as a checksum.

3. The arrangement according to claim 1, further comprising:

a permanently-magnetized marking piece located in the position identifier, wherein the permanently-magnetized marking piece comprises a plurality of consecutive magnetic areas, magnetic poles of any two immediately adjacent consecutive magnetic areas are always of opposite directions to each other, and the consecutive magnetic areas are spaced apart with a second predetermined distance from each other in the direction of movement of the elevator car; and a measuring device located in the measuring apparatus and measuring an external magnetic field of the permanently-magnetized marking piece.

4. The arrangement according to claim 3, wherein the plurality of consecutive magnetic areas are four magnetic areas fitted consecutively.

5. The arrangement according to claim 3, wherein the measuring device includes a plurality of Hall sensors, and a distance between a pair of two immediately adjacent Hall sensors is different from a distance between at least another pair of two immediately adjacent Hall sensors.

6. A method for determining a position of an elevator car in an elevator hoistway, comprising the steps of:

fitting a measuring apparatus that moves along with the elevator car in connection with the elevator car;

forming an electromagnetic radio-frequency measuring signal by the measuring apparatus, for determining the position of the elevator car;

fitting a position identifier in a selected location in relation to the elevator hoistway;

inductively connecting the position identifier to the electromagnetic radio-frequency measuring signal;

after connecting, sending a determined pulse pattern by the position identifier to the measuring apparatus via the electromagnetic radio-frequency measuring signal; and individualizing the position identifier in question by the measuring apparatus based on the determined pulse pattern, wherein the step of fitting the position identifier comprises:

fitting at least two RFID units into the position identifier; and arranging the at least two RFID units spaced apart from each other with a predetermined distance in the direction of movement of the elevator car.

7. The method according to claim 6, further comprising the steps of:

fitting an identification of the position identifier as a part of the pulse pattern formed by the position identifier; and fitting a checksum of the identification as a part of the pulse pattern formed by the position identifier.

8. The method according to claim 6, further comprising the steps of:

providing a permanently-magnetized marking piece with a plurality of consecutive magnetic areas spaced apart with a second predetermined distance from each other in a direction of movement of the elevator car;

arranging the plurality of consecutive magnetic areas such that magnetic poles of any two immediately adjacent consecutive magnetic areas are always of opposite directions to each other; and measuring an external magnetic field of the permanently-magnetized marking piece.

9. The method according to claim 8, wherein the plurality of consecutive magnetic areas are four magnetic areas fitted consecutively.

10. The method according to claim 8, wherein the step of measuring the external magnetic field of the permanently-magnetized marking piece includes:

arranging a plurality of Hall sensors spaced apart from each other such that a distance between a pair of two immediately adjacent Hall sensors is different from a distance between at least another pair of two immediately adjacent Hall sensors; and measuring the external magnetic field of the permanently-magnetized marking piece by the plurality of Hall sensors.

11. The arrangement according to claim 1, wherein the at least two RFID units are arranged such that zones determined by the at least two RFID units partly overlap each other.

12. The method according to claim 6, wherein the at least two RFID units are arranged such that zones determined by the at least two RFID units partly overlap each other.

* * * * *

UNITED STATES PATENT AND TRADEMARK OFFICE

CERTIFICATE OF CORRECTION

PATENT NO. : 8,276,716 B2
APPLICATION NO. : 13/274028
DATED : October 2, 2012
INVENTOR(S) : Timo Meri et al.

It is certified that error appears in the above-identified patent and that said Letters Patent is hereby corrected as shown below:

ON THE TITLE PAGE:

At item (63), correct the Related U.S. Application Data to read as follows:

-- (63) Continuation of application No. 12/984,815, filed on Jan. 5, 2011, now Pat. No. 8,123,003, which is a continuation of application No. PCT/FI2009/000062, filed on Jun. 25, 2009. --.

Insert the following:

-- (30) Foreign Application Priority Data

Aug. 12, 2008 (FI) ..... 20080460 --.

Signed and Sealed this
First Day of January, 2013

David J. Kappos

David J. Kappos
*Director of the United States Patent and Trademark Office*